US005521037A

United States Patent [19]

Nagase et al.

[11] Patent Number: 5,521,037

[45] Date of Patent: May 28, 1996

[54] INTERMEDIATE TRANSFER MATERIAL, AND AN IMAGE FORMING METHOD USING IT

[75] Inventors: Kimikazu Nagase; Takashi Taira; Sachio Suzuki; Hisayoshi Yamada, all of Otsu, Japan

[73] Assignee: Toray Industries, Inc., Tokyo, Japan

[21] Appl. No.: 307,787

[22] PCT Filed: Jan. 28, 1994

[86] PCT No.: PCT/JP94/00125

§ 371 Date: Nov. 30, 1994

§ 102(e) Date: Nov. 30, 1994

[87] PCT Pub. No.: WO94/18608

PCT Pub. Date: Aug. 18, 1994

[30] Foreign Application Priority Data

| | | | |
|---|---|---|---|
| Feb. 3, 1993 | [JP] | Japan | 5-016301 |
| Jul. 13, 1993 | [JP] | Japan | 5-173239 |
| Oct. 28, 1993 | [JP] | Japan | 5-270475 |

[51] Int. Cl.[6] ..... G03G 13/16

[52] U.S. Cl. ..... 430/126; 430/99; 355/285

[58] Field of Search ..... 428/332; 355/285; 430/99, 126

[56] References Cited

U.S. PATENT DOCUMENTS

| | | | |
|---|---|---|---|
| 5,319,427 | 6/1994 | Sakurai et al. | 355/285 |
| 5,403,656 | 4/1995 | Takeuchi et al. | 428/332 |

*Primary Examiner*—John Goodrow

*Attorney, Agent, or Firm*—Birch, Stewart, Kolasch & Birch

[57] ABSTRACT

The present invention relates to an intermediate transfer material, used for an image forming method of developing an electrostatic latent image on an electrostatic latent image carrier utilizing a liquid toner, electrostatically transferring the image visualized by development onto an intermediate transfer material, and re-transferring visible image from the intermediate transfer material onto final transfer objects, utilizing as the intermediate transfer material at least a silicone rubber layer, an adhesive layer and a conductive fluorine rubber layer in this order from the outer surface side thereof.

The intermediate transfer material of the present invention is excellent in durability and transferability, and so the image forming method using said intermediate transfer material can provide a high quality image at high reproducibility.

17 Claims, No Drawings

INTERMEDIATE TRANSFER MATERIAL, AND AN IMAGE FORMING METHOD USING IT

BACKGROUND OF THE INVENTION

1. Technical Field

The present invention relates to an intermediate transfer material used for an image forming method of developing an electrostatic latent image on an electrostatic latent image carrier utilizing a liquid toner. The image, which is visualized by the development, is electrostatically transferred onto an intermediate transfer material, and the re-transferring from the intermediate transfer material onto final transfer objects, for example, an intermediate transfer material used for the image forming method adopted in copiers and laser beam printers.

2. Background Techniques

The intermediate transfer materials used for the above image forming method include the following.

For example, EP Laid-Open No. 399186 (Conventional Example 1) discloses an intermediate transfer material with a two-layer elastic layer consisting of a thin dielectric layer smooth on the surface and a conductive layer supporting the dielectric layer, and as for the material of the dielectric layer, it is only stated to simply use silicone coating or fluorine coating, etc.

Japanese Patent Laid-Open (Kokai) No. 3-243973 (Conventional Example 2) discloses an intermediate transfer material with an elastic layer smooth on the surface and capable of absorbing the solvent in the liquid toner. The elastic layer consists of a dielectric layer and a conductive layer. An example of the intermediate material has a conductive silicone rubber coated with an insulating silicone rubber.

Furthermore, U.S. Pat. No. 5,099,286 (Conventional Example 3) discloses an intermediate transfer material with a dielectric layer formed on a conductive base. An example of the intermediate transfer material has a dielectric layer made of polytetrafluoroethylene layer formed on a conductive base made of urethane rubber.

The intermediate transfer materials used for the above mentioned image forming method are required to satisfy the following requirements.

(1) The visible image should be able to be efficiently transferred onto the intermediate transfer material.

(2) The visible image on the intermediate transfer material should be able to be efficiently re-transferred onto final transfer objects.

(3) The intermediate transfer material should be durable.

However, the above Conventional Examples 1 to 3 do not satisfy all of the requirements (1) to (3).

For example, if a material like silicone coating or fluorine coating is simply used as in Conventional Example 1, the durability is not sufficient. In Conventional Example 2, since a conductive silicone rubber is used for the elastic layer, the solvent used in the liquid toner swells the elastic layer, to disturb the visible image on the intermediate transfer material. Furthermore in Comparative Example 3, since polyurethane rubber is used for the elastic layer, re-transferring onto the final transfer objects by a heat roller cannot be effected since polyurethane rubber is insufficient in heat resistance.

SUMMARY OF THE INVENTION

The present invention has been completed to overcome the above disadvantages. An object of the present invention is to provide an intermediate transfer material which satisfies all of the requirements whereby a visible image can be efficiently transferred onto the intermediate transfer material; the visible image on the intermediate transfer material is efficiently re-transferred onto final transfer objects, and that the intermediate transfer material should be durable.

Another object of the present invention is to obtain a high quality image at high reproducibility when the image is formed by using the intermediate transfer material.

The intermediate transfer material of the present invention uses a conductive fluorine rubber for the conductive elastic layer. So, even when a heated roller containing a heat source is used for re-transfer of the visible image from the intermediate transfer material onto the final transfer objects, it is sufficient in heat resistance to allow excellent transfer. Furthermore, an adhesive layer is formed between the conductive fluorine rubber layer and a silicone rubber layer, or the surface release layer contains a tackifier such as an aminosilane coupling agent, to make the intermediate transfer material itself sufficiently practically durable. Therefore, if the intermediate transfer material of the present invention is used for forming an image, the image obtained is high in quality and can be obtained at high reproducibility.

DETAILED DESCRIPTION OF THE INVENTION

The objects of the present invention can be achieved by the following (1) or (2).

(1) An intermediate transfer material A is used for an image forming method of developing an electrostatic latent image on an electrostatic latent image carrier utilizing a liquid toner. An image, visualized by development, is electrostatically transferred onto an intermediate transfer material and the viable image is re-transferred from the intermediate transfer material onto final transfer objects. The intermediate transfer material comprises at least a silicone rubber layer, an adhesive layer and a conductive fluorine rubber layer in this order from the outer surface side thereof.

(2) An intermediate transfer material B, is also used for an image forming method of developing an electrostatic latent image on an electrostatic latent image carrier utilizing a liquid toner. An image, visualized by development, is electrostatically transferred onto an intermediate transfer material and the visible image is re-transferred from the intermediate transfer material onto final transfer objects. The intermediate transfer material comprises at least a surface release layer containing a silicone and a tackifier and a conductive fluorine rubber layer in this order from the outer surface side thereof.

The intermediate transfer material A of the present invention has at least a silicone rubber layer, an adhesive layer and a conductive fluorine rubber layer in this order from the outer surface side thereof, and can be formed as a belt or a drum with at least a conductive layer, an adhesive layer and a silicone rubber layer laminated in this order on a belt or drum substrate made of aluminum, iron or a plastic material, etc. Furthermore, an adhesive layer may be formed between the conductive fluorine rubber layer and the substrate or between the conductive fluorine rubber layer and the drum.

The silicone rubber layer is formed as the outermost surface layer of the intermediate transfer material A. The silicone rubber as the outermost layer lowers the adhesive strength of the liquid toner onto the intermediate transfer material, and acts to enhance the transferability from the intermediate transfer material to the final transfer objects. Furthermore, it also acts to let the intermediate transfer material absorb the carrier solvent of the toner, for immobilizing the toner image of the intermediate transfer material to some extent, thereby enhancing multiple transferability (from electrostatic latent image carriers to the intermediate transfer material). The silicone rubber layer can be formed by, but not limited to, any of known materials, and as for example, methyl silicone rubber, methylphenyl silicone rubber, methylvinyl silicone rubber, etc. The thickness of the silicone rubber layer should be preferably 0.2 to less than 5 μm, more preferably 0.5 to less than 3 μm. If the thickness is less than 0.2 μm, the transfer from the intermediate transfer material to the final transfer objects is not sufficient, and if 5 μm or more, color superimposition becomes difficult.

Below the silicone rubber layer, the adhesive layer is formed to achieve adhesion to the conductive fluorine rubber layer. Without the adhesive layer, the adhesion between the silicone rubber layer and the conductive fluorine rubber layer is not sufficient, and as a result, the intermediate transfer material obtained is not good in durability or printing resistance, and hence not practical.

The adhesive layer can be formed by any primer usually used for the bonding of silicone rubbers, but it is preferable that the adhesive layer contains at least one member selected from aminosilane coupling agents and titanate coupling agents.

The aminosilane coupling agents include, but are not limited to, 3-aminopropyltriethoxysilane, 3-aminopropyltrimethoxysilane, 3-aminopropyldiethylmethylsilane, N-(2-aminoethyl)-3-aminopropyltrimethoxysilane, p-aminophenyltrimethoxysilane, etc.

Among them, especially 3-aminopropyltriethoxysilane and N-(2-aminoethyl)-3-aminopropyltrimethoxysilane are preferable.

The titanate coupling agents include, but are not limited to, tetramethyl titanate, tetraethyl titanate, tetrapropyl titanate, tetraisopropyl titanate, tetrabutyl titanate, tetra(2-ethyl)hexyl titanate, tetrastearyl titanate, tetraphenyl titanate, tetratolyl titanate, tetraxylyl titanate, etc. Among them, especially tetraisopropyl titanate and tetrabutyl titanate are preferable.

It is also possible to mix a known silane coupling agent other than aminosilane coupling agents. It can be selected from, but not limited to, allyldimethylsilane, benzyldimethylsilane, 2-(bicycloheptyl)methyldichlorosilane, 2-acetoxyethyltrichlorosilane, etc.

Furthermore, it is also possible to add a resin, etc. for reinforcing the strength of the adhesive layer itself. The resin can be selected from, but not limited to, acrylic resin, polyethylene, polypropylene, polystyrene, nylon resin, etc.

The amount of the aminosilane coupling agent and/or titanate coupling agent in the adhesive layer should be preferably 10 to 100 wt %, more preferably 20 to 100 wt %, furthermore preferably 40 to 100 wt %.

If the amount of the aminosilane coupling agent and/or titanate coupling agent is too small, the good properties of the aminosilane coupling agent and titanate coupling agent may be lost.

The coupling agent may be diluted, as required, by a solvent such as methanol, ethanol, propanol, butanol, hexane, benzene, toluene, xylene, methylene chloride, chloroform or carbon tetrachloride.

The thickness of the adhesive layer should be preferably 0.2 to less than 5 μm. If less than 0.2 μm, adhesiveness is insufficient, and if 5 μm or more, cohesive failure occurs in the adhesive layer to degrade adhesiveness. Furthermore, since the thickness of the dielectric layer (silicone rubber layer+adhesive layer) becomes large, color superimposition becomes difficult.

In the intermediate transfer material A of The present invention, the conductive fluorine rubber layer is formed below the adhesive layer which, in turn, is formed under the silicone rubber layer. The conductive fluorine rubber layer is used as a conductive elastic layer. When a heat roller containing a heat source is used for transfer from the intermediate transfer material to the final transfer objects, the conductive elastic layer is required to be high in heat resistance, and moreover, is required not to become swollen by the hydrocarbon solvent used in the liquid toner. So, the use of a conductive fluorine rubber layer is required.

The conductive fluorine rubber layer used in the intermediate material A of the present invention can be a layer formed by a rubber based on vinylidene fluoride-hexafluoropropene, vinylidene fluoride-chlorotrifluoroethylene, vinylidene fluoride-pentafluoropropene, tetrafluoroethylene-propylene, fluorine-containing silicone, fluorine-containing nitroso, fluorine-containing triazine or fluorine-containing phosphazene, etc. made conductive by dispersing carbon black therein.

The carbon black to be dispersed into the fluorine rubber can by any known carbon black, but the use of Kaetchen black is preferable to achieve good conductivity. The amount of dispersed carbon black should be preferably 2 to 10 wt %. If less than 2 wt %, the conductivity is poor, and if more than 10 wt %, the conductive fluorine rubber layer loses its surface smoothness.

The conductive fluorine rubber layer should be preferably $10^8$ (Ω·cm) or less, more preferably $10^5$ (Ω·cm) or less in volume resistivity. If the volume resistivity is more than $10^8$ (Ω·cm), the transferability tends to be lowered when a visible image having a color on a sensitive material is transferred onto a visible image of another color on the intermediate transfer material when it is intended to retransfer a full color visible image from the intermediate transfer material onto the final transfer objects by one transfer action. Moreover, the hardness of the conductive fluorine rubber layer should be preferably a shore hardness A20 to D50. If lower than Shore A20, the visible image transferred onto the intermediate transfer material from the electrostatic latent image carrier (sensitive material) is liable to be disturbed. If higher than Shore D50, the transfer rate from the intermediate transfer material onto the final transfer objects is liable to be low when the final transfer objects are insufficiently smooth on the surface like paper.

The thickness of the conductive fluorine rubber layer should be preferably 50 to less than 5,000 μm, more preferably 500 μm to less than 3,000 μm. If 5000 μm or more, the image transferred from the electrostatic latent image carrier (sensitive material) to the intermediate transfer material is liable to be disturbed. Furthermore, if less than 50 μm, the transfer rate from the intermediate transfer material onto the final transfer objects is liable to be low, particularly when the final transfer objects are insufficiently smooth on the surface, like paper.

The lower inner part (substrate or drum side) of the conductive fluorine rubber layer can be replaced by a layer of another material. For example, it can be replaced by a non-conductive fluorine rubber layer, butyl rubber layer, polyurethane rubber layer or neoprene rubber layer, etc. acting as a cushioning layer. The thickness of the cushioning layer made of another material which can partially replace the conductive fluorine rubber layer is 40 to 4,000 μm.

The intermediate transfer material B of the present invention has at least a surface release layer containing a silicone rubber and a tackifier and a conductive fluorine rubber layer in this order from the outer surface side thereof. It can be formed as a belt with at least the conductive fluorine rubber layer arid the surface release layer containing a silicone rubber and a tackifier laminated in this order on a substrate of aluminum, iron or plastic material, etc., or alternatively it can be formed as a drum with at least the conductive fluorine rubber layer and the surface release layer containing a silicone rubber and an aminosilane coupling agent laminated in this order on a drum of aluminum or iron, etc. Moreover, an adhesive layer may also be provided between the conductive fluorine rubber layer and the substrate or between the conductive fluorine rubber layer and the drum.

The outer surface layer of the intermediate transfer material B is the surface release layer containing a silicone rubber and a tackifier.

The silicone rubber contained in the surface release layer acts to lower the adhesive strength of the liquid toner to the intermediate transfer material and to enhance the transferability from the intermediate transfer material onto the final transfer objects. It also functions to let the intermediate transfer material absorb the carrier solvent of the toner, for immobilizing the toner image of the intermediate transfer material to some extent and also to enhance the multiple transferability (from electrostatic latent image carriers to the intermediate transfer material). The silicone rubber can be selected from, but not limited to, known methyl silicone rubber, methylphenyl silicone rubber, methylvinyl silicone rubber, etc.

The tackifier contained in the surface release layer can be an aminosilane coupling agent. It acts to enhance the adhesion between the surface release layer and the conductive fluorine rubber layer for improving the durability of the intermediate transfer material. The aminosilane coupling agent can be selected from, but not limited to, 3-aminopropyltriethoxysilane, 3-aminopropyltrimethoxysilane, 3-aminopropyldiethylmethylsilane, N-(2-aminoethyl)-3-aminopropyltrimethoxysilane, p-aminophenyltrimethoxysilane, etc.

It is preferable that the surface release layer contains 1 to 20 wt %, more preferably 2 to 10 wt % of an aminosilane coupling agent. If the amount of the aminosilane coupling agent is less than 1 wt %, the adhesive strength between the surface release layer and the conductive fluorine rubber layer is not sufficient, to lower the durability of the intermediate transfer material. If the amount of the aminosilane coupling agent is more than 20 wt %, the adhesive strength of the liquid toner to the intermediate transfer material is so high that the transferability from the intermediate transfer material to the final transfer objects becomes insufficient.

The surface release layer may also contain a cross-linking agent for the silicone rubber such as methyltrimethoxysilane.

The thickness of the surface release layer should be preferably 0.2 to 5 μm, more preferably 0.5 to 3 μm. If less than 0.2 μm, the transfer rate from the intermediate transfer material to the final transfer objects is not sufficient, and if more than 5 μm, color superimposition becomes difficult.

The intermediate transfer material B of the present invention has the conductive fluorine rubber layer under the surface release layer. The conductive fluorine rubber layer used can be the same as the conductive fluorine rubber layer described for the intermediate transfer material (A).

The image forming method using the intermediate transfer material of the present invention is described below.

The intermediate transfer material of the present invention is used for an image forming method of developing am electrostatic latent image on an electrostatic latent image carrier utilizing a liquid toner. An image, visualized by development, is electrostatically transferred onto an intermediate transfer material and the visible image is re-transferred from the intermediate transfer material onto final transfer objects.

It is preferable that the intermediate transfer material of the present invention is used for an image forming method, in which a final transfer object is brought into close contact with the intermediate transfer material by a pressure roller, for re-transferring the visible image from the intermediate transfer onto the final transfer object. The pressure roller used herein can be a metallic roller or a roller prepared by covering the metallic roller on the surface thereof with a highly heat resistant rubber such as a silicone rubber or fluorine rubber, to assure better adhesion to the intermediate transfer material. Above all, it is preferable that the intermediate transfer material of the present invention is used in an image forming method using a heating roller containing a heat source such as a pressure roller. The pressure roller can be a cylindrical structure containing a heat source such as a ceramic heater or a halogen lamp, etc.

It is moreover preferable that the image forming method is a color image forming method, in which many colors are superimposed to form a color image on the intermediate transfer material so that the visible image on the intermediate transfer material may be re-transferred onto each final transfer object by one transfer action.

The final transfer objects in the present invention can be any material which allows ordinary printing, such as paper, plastic film, metal, cloth or a wooden plate.

The present invention is described below with reference to the examples, but should not be limited by the contents thereof.

EXAMPLE 1

A 1,000 μm thick vulcanized conductive fluorine rubber layer of Shore D20 prepared by adding 5 wt % of Kaetchen black to tetrafluoroethylene-propylene rubber ("Arras" #150 produced by Asahi Glass) was formed on a 200 μm thick aluminum sheet, and on it, a 1 μm thick adhesive layer of 3-aminopropyltriethoxysilane was formed by bar coating. Further on it, a 2 μm thick oxime-removed room temperature cured methyl silicone rubber layer was formed by bar coating, to form an intermediate transfer material.

Se drums were used as sensitive materials and liquid developers were used for development to form images of yellow, magenta, cyan and black in this order on the intermediate transfer material stuck onto the drums one after another, for forming a full color image on the intermediate transfer material. The full color image was transferred onto paper at a linear pressure of 20 kg at a pressure roller temperature of 150° C., to obtain a good printed sheet. Furthermore, 2,000 sheets of paper were continuously printed, but the printed sheets were as good as the first printed sheet, while the intermediate transfer material could be used without any defect.

EXAMPLE 2

A 500 μm thick vulcanized conductive fluorine rubber layer of Shore D20 prepared by adding 5 wt % of Kaetchen black to tetrafluoroethylene-propylene rubber ("Arras" #150 produced by Asahi Glass) was formed on a 180 mm dia.

aluminum drum, and on it, a 1 μm thick adhesive layer of 3-aminopropyltrimethoxysilane was formed by bar coating. Further on it, a 1.5 μm thick acetic acid-removed room temperature cured methyl silicone rubber layer was formed by bar coating, to form an intermediate transfer material.

The intermediate transfer material was used for printing as done in Example 1, to obtain a good printed sheet. Furthermore, 2,000 sheets of paper were continuously printed, but the printed sheets were as good as the first printed sheet, while the intermediate transfer material could be used without any defect.

EXAMPLE 3

A 800 μm thick vulcanized conductive fluorine rubber layer of Shore D30 prepared by adding 6 wt % of Kaetchen black to vinylidene fluoride-hexafluoropropene rubber ("Daiel" G-501 produced by Daikin Kogyo) was formed on a 200 μm thick stainless steel sheet, and on it, a 1 μm thick adhesive layer of 3-aminopropyltrimethoxysilane was formed by bar coating. Further on it, a 1 μm thick acetic acid-removed room temperature cured methyl silicone rubber layer was formed by bar coating, to form an intermediate transfer material.

The intermediate transfer material was formed like a belt and used for printing as done in Example 1, to obtain a good printed sheet. Furthermore, 2,000 sheets of paper were continuously printed, but the printed sheets were as good as the first printed sheet, while the intermediate transfer material could be used without any defect.

EXAMPLE 4

A 1,000 μm thick vulcanized conductive fluorine rubber layer of Shore D20 prepared by adding 5 wt % of Kaetchen black to tetrafluoroethylene-propylene rubber ("Afras" #150 produced by Asahi Glass) was formed on a 200 μm thick aluminum sheet, and on it, a 1 μm thick layer of tetraisopropyl titanate was formed by bar coating. Further on it, a 2 μm thick oxime-removed room temperature cured methyl silicone rubber layer was formed by bar coating, to form an intermediate transfer material.

Se drums were used as sensitive materials and liquid developers were used for development to form images of yellow, magenta, cyan and black in this order on the intermediate transfer material stuck onto the drums one after another, for forming a full color image on the intermediate transfer material. The full color image was transferred onto paper at a linear pressure of 20 kg at a pressure roller temperature of 150° C., to obtain a good printed sheet. Furthermore, 2,000 sheets of paper were continuously printed, but the printed sheets were as good as the first printed sheet, while the intermediate transfer material could be used without any defect.

EXAMPLE 5

A 500 μm thick vulcanized conductive fluorine rubber layer of Shore D20 prepared by adding 5 wt % of Kaetchen black to tetrafluoroethylene-propylene rubber ("Afras" #150 produced by Asahi Glass) was formed on a 180 mm dia. aluminum drum, and on it, a 1 μm thick layer of tetra(2-ethyl)hexyl titanate was formed by bar coating. Further on it, a 1.5 μm thick acetic acid-removed room temperature cured methyl silicone rubber layer was formed by bar coating, to form an intermediate transfer material.

The intermediate transfer material was used for printing as done in Example 1, to obtain a good printed sheet. Furthermore, 2,000 sheets of paper were continuously printed, but the printed sheets were as good as the first printed sheet, while the intermediate transfer material could be used without any defect.

EXAMPLE 6

A 800 μm thick vulcanized conductive fluorine rubber layer of Shore D30 prepared by adding 6 wt % of Kaetchen black to vinylidene fluoride-hexafluoropropene rubber ("Daiel" G-501 produced by Daikin Kogyo) was formed on a 200 μm thick stainless steel sheet, and on it, a 1 μm thick layer of a coupling agent obtained by mixing 40 wt % of tetraethyl titanate and 60 wt % of allyldimethylsilane was formed by bar coating. Further on it, a 1 μm thick acetic acid-removed room temperature cured methyl silicone rubber layer was formed by bar coating, to form an intermediate transfer material.

The intermediate transfer material was formed like a belt and used for printing as done in Example 1, to obtain a good printed sheet. Furthermore, 2,000 sheets of paper were continuously printed, but the printed sheets were as good as the first printed sheet, while the intermediate transfer material could be used without any defect.

EXAMPLE 7

A 800 μm thick vulcanized conductive fluorine rubber layer of Shore D30 prepared by adding 6 wt % of Kaetchen black to vinylidene fluoride-hexafluoropropene rubber ("Daiel" G-501 produced by Daikin Kogyo) was formed on a 200 μm thick stainless steel sheet, and on it, a 1 μm thick layer of a coupling agent obtained by mixing 5 wt % of tetraethyl titanate and 95 wt % of allyldimethylsilane was formed by bar coating. Further on it, a 1 μm thick acetic acid-removed room temperature cured methyl silicone rubber layer was formed by bar coating, to form an intermediate transfer material.

The intermediate transfer material was formed like a belt and used for printing as done in Example 1, to obtain a good printed sheet. Further sheets of paper were continuously printed, but after printing more than 100 sheets, the printed sheets became defective. The intermediate transfer material was removed and examined, to find that the silicone rubber layer had peeled from the conductive elastic layer.

EXAMPLE 8

A 1,000 μm thick vulcanized conductive fluorine rubber layer of Shore A60 prepared by adding 5 wt % of Kaetchen black to tetrafluoroethylene-propylene rubber ("Afras" #150 produced by Asahi Glass) was formed on a 200 μm thick aluminum sheet, and on it, a 1 μm thick adhesive layer of N-(2-aminoethyl)-3-aminopropyltrimethoxysilane was formed by bar coating. Further on it, a 1.5 μm thick oxime-removed room temperature cured methyl silicone rubber layer was formed by bar coating, to form an intermediate transfer material.

OPC drums (organic sensitive materials) were used as sensitive materials and liquid developers were used for development to form images of yellow, magenta, cyan and black in this order on the intermediate transfer material stuck onto the drums one after another, for forming a full color image on the intermediate transfer material. The full color image was transferred onto paper at a linear pressure of 20 kg at a pressure roller temperature of 150° C., to obtain a good printed sheet. Furthermore, 2,000 sheets of paper were continuously printed, but the printed sheets were as good as the first printed sheet, while the intermediate transfer material could be used without any defect.

EXAMPLE 9

A 750 μm thick vulcanized conductive fluorine rubber layer of Shore A70 prepared by adding 7 wt % of Kaetchen black to tetrafluoroethylene-propylene rubber ("Afras" #150 produced by Asahi Glass) was formed on a 250 μm thick aluminum sheet, and on it, a 1 μm thick adhesive layer of tetrabutyl titanate was formed by bar coating. Further on it, a 1.5 μm thick oxime-removed room temperature cured methyl silicone rubber layer was formed by bar coating, to form an intermediate transfer material.

Amorphous silicon drums were used as sensitive materials and liquid developers were used for development to form images of yellow, magenta, cyan and black in this order on the intermediate transfer material stuck onto the drums one after another, to form a full color image on the intermediate transfer material. The full color image was transferred onto paper at a linear pressure of 20 kg at a pressure roller temperature of 180° C., to obtain a good printed sheet. Furthermore, 2,000 sheets of paper were continuously printed, but the printed sheets were as good as the first printed sheet, while the intermediate transfer material could be used without any defect.

EXAMPLE 10

A 1,000 μm thick vulcanized conductive fluorine rubber layer of Shore D20 prepared by adding 5 wt % of Kaetchen black to tetrafluoroethylene-propylene rubber ("Afras" #150 produced by Asahi Glass) was formed on a 200 μm thick aluminum sheet, and on it, a 2 μm thick surface release layer composed of the following was formed by bar coating, to form an intermediate transfer material.

| | |
|---|---|
| 3-aminopropyltriethoxysilane | 5 wt % |
| Oxime-removed room temperature cured methyl silicone rubber | 95 wt % |

Se drums were used as sensitive materials and liquid developers were used to form images of yellow, magenta, cyan and black in this order on the intermediate transfer material stuck onto the drums one after another, to form a full color image on the intermediate transfer material. The full color image was transferred onto paper at a linear pressure of 20 kg at a pressure roller temperature of 150° C., to obtain a good printed sheet. Furthermore, 2,000 sheets of paper were continuously printed, but the printed sheets were as good as the first printed sheet, while the intermediate transfer material could be used without any defect.

EXAMPLE 11

A 500 μm thick vulcanized conductive fluorine rubber layer of Shore D20 prepared by adding 5 wt % of Kaetchen black to tetrafluoroethylene-propylene rubber ("Afras" #150 produced by Asahi Glass) was formed on a 180 mm dia. aluminum drum, and on it, a 1.5 μm thick surface release layer composed of the following was formed by bar coating, to form an intermediate transfer material.

| | |
|---|---|
| 3-aminopropyltrimethoxysilane | 3 wt % |
| Acetic acid-removed room temperature cured methyl silicone rubber | 97 wt % |

The intermediate transfer material was used for printing as done in Example 10, to obtain a good printed sheet. Furthermore, 2,000 sheets of paper were continuously printed, but the printed sheets were as good as the first printed sheet, while the intermediate transfer material could be used without any defect.

EXAMPLE 12

A 800 μm thick vulcanized conductive fluorine rubber layer of Shore D30 prepared by adding 6 wt % of Kaetchen black to vinylidene fluoride-hexafluoropropene rubber ("Daiel" G-501 produced by Daikin Kogyo) was formed on a 200 μm thick stainless steel sheet, and on it, a 1 μm chick surface release layer composed of the following was formed by bar coating, to form an intermediate transfer material.

| | |
|---|---|
| N-(2-aminoethyl)-3-aminopropyltrimethoxysilane | 3 wt % |
| Acetic acid-removed room temperature cured methyl silicone rubber | 97 wt % |

The intermediate transfer material was formed like a belt and used for printing as done in Example 10, to obtain a good printed sheet. Furthermore, 2,000 sheets of paper were continuously printed, but the printed sheets were as good as the first printed sheet, while the intermediate transfer material could be used without any defect.

Comparative Example 1

A 1,000 μm thick vulcanized conductive fluorine rubber layer of Shore D20 prepared by adding 5 wt % of Kaetchen black to tetrafluoroethylene-propylene rubber ("Afras" #150 produced by Asahi Glass) was formed on a 200 μm thick aluminum sheet, and directly on it, a 2 μm thick oxime-removed room temperature cured silicone rubber layer was formed by bar coating, to form an intermediate transfer material.

The intermediate transfer material was used for printing as done in Example 1, and up to 100 sheets were printed well. After printing more than 100 sheets, the printed sheets became defective. The intermediate transfer material was removed and examined, to find that the silicone rubber layer had peeled from the conductive fluorine rubber layer.

Comparative Example 2

A 1 mm thick conductive silicone rubber layer of $10^3$ Ω·cm in volume resistivity was formed on a 200 μm thick aluminum sheet, and on it, 1.5 μm thick oxime-removed room temperature cured silicone rubber layer was formed by bar coating, to form an intermediate transfer material.

As done in Example 1 printing was effected in the order of yellow, magenta and cyan. The intermediate transfer material was swollen by the liquid toner, to disturb the visible image, and good printed sheets could not be obtained.

Comparative Example 3

A 1 mm thick conductive urethane rubber layer of $10^3$ Ω·cm in volume resistivity was formed on a 200 μm thick aluminum sheet, and on it, a 1 μm thick adhesive layer of 3-aminopropyltrimethoxysilane was formed by bar coating Further on it a 1.5 μm thick acetic acid-removed room temperature cured methyl silicone rubber layer was formed by bar coating, to form an intermediate transfer material.

Printing was effected as done in Example 1. The urethane rubber layer was thermally deformed, not to allow smooth transfer from the intermediate transfer material onto paper, and good printed sheets could not be obtained.

Comparative Example 4

A 1 mm thick conductive urethane rubber layer of $10^3$ Ω·cm in volume resistivity was formed on a 200 μm thick aluminum sheet, and on it, a 1 μm thick surface release layer composed of the following was formed by bar coating, to form an intermediate transfer material.

| | |
|---|---|
| N-(2-aminoethyl)-3-aminopropyltrimethoxysilane | 3 wt % |
| Acetic acid-removed room temperature cured methyl silicone rubber | 97 wt % |

Printing was effected as done in Example 1. The urethane rubber layer was thermally deformed, not to allow smooth transfer from the intermediate transfer material onto paper, and good printed sheets could not be obtained.

Industrial Applicability

The intermediate transfer material of the present invention is used for an image forming method of developing an electrostatic latent image on an electrostatic latent image carrier by a liquid toner, electrostatically transferring the image visualized by the development onto an intermediate transfer material, and re-transferring the visible image on the intermediate transfer material onto final transfer objects. The image forming method is used, for example, in copiers and laser beam printers.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. An intermediate transfer material used in an image forming method of developing an electrostatic latent image on an electrostatic latent image carrier, utilizing a liquid toner, electrostatically transferring the image visualized by development onto an intermediate transfer material, and re-transferring the visible image from the intermediate transfer material onto final transfer objects, which comprises at least a silicone rubber layer, an adhesive layer and a conductive fluorine rubber layer formed in this order from the outer surface side thereof, said silicone rubber layer having a thickness of 0.2 to less than 5 μm.

2. The intermediate transfer material, according to claim 1, wherein the adhesive layer contains an aminosilane coupling agent.

3. The intermediate transfer material, according to claim 1, wherein the adhesive layer contains a titanate coupling agent.

4. The intermediate transfer material, according to claim 1, wherein the adhesive layer contains an aminosilane coupling agent and a titanate coupling agent.

5. The intermediate transfer material, according to claim 1, wherein the thickness of the adhesive layer is 0.2 to less than 5 μm.

6. An intermediate transfer material used in an image forming method of developing an electrostatic latent image on an electrostatic latent image carrier, utilizing a liquid toner, electrostatically transferring the image visualized by development onto an intermediate transfer material, and re-transferring the visible image from the intermediate transfer material onto final transfer objects, which comprises at least a surface release layer containing a silicone and a tackifier and a conductive fluorine rubber layer formed in this order from the outer surface side thereof, said surface release layer having a thickness of 0.2 to 5 μm.

7. The intermediate transfer material, according to claim 6, wherein the tackifier is an aminosilane coupling agent.

8. The intermediate transfer material, according to claim 6, wherein the tackifier is contained by 1 to 20 wt % in the surface release layer.

9. The intermediate transfer material, according to claim 1 or 6, wherein the thickness of the conductive fluorine rubber layer is 50 to less than 5,000 μm.

10. An image forming method of developing an electrostatic latent image on an electrostatic latent image carrier utilizing a liquid toner, and electrostatically transferring the image visualized by development onto an intermediate transfer material, and re-transferring the visible image from the intermediate transfer material onto final transfer objects, which comprises utilizing as said intermediate transfer material at least a silicone rubber layer, an adhesive layer and a conductive fluorine rubber layer formed in this order from the outer surface side thereof, said silicone rubber layer having a thickness of 0.2 to less than 5 μm.

11. The image forming method, according to claim 10, wherein each final transfer object is brought into close contact with said intermediate transfer material by a pressure roller to re-transfer the visible image from the intermediate transfer material onto the final transfer object.

12. The image forming method, according to claim 11, wherein the pressure roller is a heated roller containing a heat source.

13. The image forming method, according to claim 10, wherein many colors are superimposed to form a color image on the intermediate transfer material for re-transferring the visible image thus formed on the intermediate transfer material onto each final transfer object by one transfer action.

14. An image forming method of developing an electrostatic latent image on an electrostatic latent image carrier utilizing a liquid toner, and electrostatically transferring the image visualized by development onto an intermediate transfer material, and re-transferring the visible image from the intermediate transfer material onto final transfer objects, which comprises at least a surface release layer containing a silicone and a tackifier and a conductive fluorine rubber layer formed in this order from the outer surface side thereof, said surface release layer having a thickness of 0.2 to 5 μm.

15. The image forming method, according to claim 14, wherein each final transfer object is brought into close contact with said intermediate transfer material by a pressure roller to re-transfer the visible image from the intermediate transfer material onto the final transfer object.

16. The image forming method, according to claim 15, wherein the pressure roller is a heated roller containing a heat source.

17. The image forming method, according to claim 14, wherein many colors are superimposed to form a color image on the intermediate transfer material for re-transferring the visible image thus formed on the intermediate transfer material onto each final transfer object by one transfer action.

* * * * *